US006640496B2

(12) United States Patent
Mullet

(10) Patent No.: US 6,640,496 B2
(45) Date of Patent: Nov. 4, 2003

(54) ANTI-DROP DEVICE

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/104,465

(22) Filed: Mar. 21, 2002

(65) Prior Publication Data

US 2003/0041520 A1 Mar. 6, 2003

Related U.S. Application Data

(63) Continuation-in-part of application No. 09/948,086, filed on Sep. 6, 2001.

(51) Int. Cl.[7] ..... E05F 11/00; E05F 3/00
(52) U.S. Cl. ..... 49/199; 49/197; 49/322
(58) Field of Search ..... 49/199, 200, 197, 49/198, 322, 449; 187/343, 345; 160/192, 189, 190, 201, 191, 188, 291, 296, 298, 193; 16/DIG. 1, 198; 292/92, 93, 94, 235, DIG. 65, 30

(56) References Cited

U.S. PATENT DOCUMENTS

| | | | | | |
|---|---|---|---|---|---|
| 2,185,828 | A | * | 1/1940 | Blodgett | 49/322 |
| 3,412,780 | A | * | 11/1968 | Moler | 160/191 |
| 4,385,471 | A | * | 5/1983 | Gabry et al. | 49/322 |
| 4,520,591 | A | * | 6/1985 | Calvagno | 49/322 |
| 4,604,828 | A | * | 8/1986 | Baarse | 49/322 |
| 4,914,862 | A | | 4/1990 | Gregory | 49/322 |
| 4,956,938 | A | * | 9/1990 | DeMent | 49/322 X |
| 5,046,544 | A | * | 9/1991 | Coluccio | 160/201 |
| 5,291,686 | A | * | 3/1994 | Sears et al. | 49/322 |
| 5,698,073 | A | * | 12/1997 | Vincenzi | 160/188 |
| 6,042,158 | A | * | 3/2000 | Horn | 49/322 X |
| 6,189,266 | B1 | * | 2/2001 | Mihalcheon | 49/322 |
| 6,253,824 | B1 | * | 7/2001 | Mullet et al. | 160/188 |
| 6,279,268 | B1 | * | 8/2001 | Beaudoin et al. | 49/322 |

FOREIGN PATENT DOCUMENTS

| | | | |
|---|---|---|---|
| CH | 340 337 | 8/1959 | |
| DE | 3413236 | 10/1985 | E05D/13/00 |
| FR | 2715965 | 8/1995 | E05D/15/38 |

* cited by examiner

*Primary Examiner*—Hugh B. Thompson
(74) *Attorney, Agent, or Firm*—Renner, Kenner, Greive, Bobak, Taylor & Weber

(57) ABSTRACT

A door system including, a door movable between a closed vertical position and an open horizontal position, a cable attached to the door and normally providing a counterbalancing force to the door, the cable extending along a vertical line adjacent the door and being normally substantially taut, and an anti-drop assembly having a pawl pivotally supported on the door and attached to the cable, a stop surface positioned adjacent to the door, and a spring operable to urge the pawl toward engagement with the stop surface, wherein when taut the cable opposes the biasing force of the spring and wherein upon the cable going slack the spring urges the pawl into engagement with the stop surface to decelerate the door.

33 Claims, 14 Drawing Sheets

ANTI-DROP DEVICE

RELATED APPLICATIONS

This application is a continuation-in-part of U.S. patent application Ser. No. 09/948,086 filed Sep. 6, 2001.

TECHNICAL FIELD

The present invention relates generally to anti-drop systems used to prevent free fall of vertically moving doors, such as garage doors or the like. More particularly, the present invention relates to such an anti-drop system having a pawl assembly that, in response to a loss of tension in the counterbalance cable, engages a stop surface adjacent to the door to impede its fall. More specifically, the present invention relates to a pawl assembly biased toward engagement with the stop surface but held in a disengaged position by the force of a taut counterbalance cable, where release of the tension within the cable, allows the pawl to swing into engagement with the stop surface and impede the fall of the door.

BACKGROUND ART

Devices which prevent the inadvertent free-fall of a vertically movable door, such as a garage door, are known in the art. One type of anti-drop system which has been used in the industry employs a spring-loaded bar that is driven outwardly such that it enters a slot on a rail held adjacent to the door to stop the door from falling. In this system, two horizontally oriented bars housed at the bottom extremity of the door are mounted side by side. The first bar is rotatable about its own axis and is attached to the lift cable of the counterbalance system of the door by means of a shift pin supported on the first bar. The pin has an oblique slope and is oriented such that when the cable is taut, the pin blocks the axial path of the spring-loaded second rod. When tension is released, however, the pin, due to its oblique slope, shifts to a position that clears the second bar allowing the second bar to move into engagement with the slots formed in the rail supported adjacent to the edge of the door. Since the shift pin is located externally of the edge of the door, clearance must be provided for the shift pin between the door edge and the rail, such that the shift pin is free to clear the second bar. This spacing may allow fluid or debris to gather in the area between the rail and the door. This debris and fluid may gather around the anti-drop mechanism and deleteriously affect its performance by interfering with proper operation of the system or corroding its components.

When operating to stop the door, the spring-loaded bar is driven axially outwardly to project through the slots formed in the rail. In this device, the bar must extend through the slot to effectively stop the door. Partial contact with the slot could cause the bar to deflect from the rail or be deformed such that the bar will not hold the door's weight. In this device, the end of the second bar is flat lying in a plane parallel to the rail, thereby offering little or no resistance to slow the downward movement of the door. Due to the uninhibited fall of the door prior to stopping, the spring-loaded bar is subjected to a large shock load when it catches the fall of the door. It is believed that this shock load could be sufficient to bend or otherwise distort the bar requiring replacement or repair before the anti-drop mechanism could be reused. In any event, assuming the spring-loaded bar is still functional after stopping the door, the bar must be manually reset and held until tension within the cable is restored sufficiently to retain the bar. Although it has been proposed to incorporate a stop flange in place of the slots formed within a rail, it will be appreciated that, despite this modification, this system has the same disadvantages. In addition, the flange in this system may bend or fail under the shock load created when stopping the door.

As a further disadvantage, when used with spring-type counterbalance systems, the tension on the cable varies with the position of the door. Typically, the greatest spring force and, thus, the greatest tension in the cable, is at the closed position. As the door approaches the open position, the spring tension in the cable is reduced and potentially could be reduced to an extent that the spring force driving the bar is not balanced resulting in inadvertent engagement of the stop mechanism. Moreover, the location of the bar mechanism at the bottom extremity of the door exposes it to dirt, debris and water that may cause the system to jam or otherwise deteriorate to the point of not performing its anti-drop function.

In another anti-drop system used in the industry, a rotating pawl placed within a housing is attached to the door's suspension cable. In this system, the rotatable pawl is held within the housing and attached to the cable by an eye that extends outside of the housing. A spring is interposed between the housing and the pawl such that when tension is on the cable, the spring is compressed. When tension is released from the cable, the spring drives the pawl downward where it engages an oblique face of a plunger corresponding to an oblique face of the pawl. This forces the pawl to rotate outward such that a portion of the pawl extends outside of the housing to engage a slot formed in a rail similar to that described with respect to the spring-loaded bar system. To effect the engagement between the pawl and plunger, the housing slides relative to the plunger. When tension is released from the cable, the housing moves downward such that a slot formed in the side of the housing is located at nearly the same height as the plunger. In this way, as the pawl is moved outwardly along the angle of the plunger, its tip can extend through the opening in the housing. The tip is provided with an oblique engagement portion that is turned outwardly to facilitate its extension through the slots in the rail. To permit the tip to rotate sufficiently to engage the slots, the housing must be spaced from the rail, and no provision is made to slow the door prior to impact.

While the use of the pawl reduces the distance that the stopping member must travel to prevent drop of the door and helps to reduce forces that might bend the pawl, this system is subject to the same corrosive elements as the spring-loaded bar system, and, due to its complexity, is even more susceptible to the effects of corrosion, which may cause the system to operate improperly or jam such that repair or replacement is necessary. Also, as in the case of the spring-loaded bar system, the reduction in tension on the cable as the door nears the open position could similarly result in unintended activation of the anti-drop mechanism.

DISCLOSURE OF THE INVENTION

It is therefore an object of the present invention to provide an upwardly-acting door system employing a simple anti-drop system to stop a falling door. Another object of the present invention is to provide an anti-drop system having a rotatable pawl assembly supported on the door, where the presence of a taut counterbalance cable between the pawl and the stop surface controls operation of the anti-drop system. Still another object of the present invention is to provide a cutout on the pawl to at least partially receive the counterbalance cable such that the cable is held within the recess as the pawl rotates toward its engaged position, helping to prevent the cable from interfering with proper engagement of the pawl.

Another object of the present invention is to provide an anti-drop system for an upwardly-acting door employing a rotatable pawl engaging a stop surface adjacent the door to stop the fall of the door, where the anti-drop system slows the downward movement of the door prior to engagement with the stop surface to reduce the shock of stopping the door. A further object of the present invention is to provide a pawl and/or stop surface with a greater frictional coefficient to slow the door prior to the pawl's contact with the stop surface.

Still another object of the present invention is to provide an anti-drop system that automatically resets upon application of tension to the door cable. A further object of the present invention is to provide a rotatable pawl that is held in a disengaged position by contact with a taut door cable, which, when the cable goes slack, allows the pawl to rotate to an engaged position to stop the door and, upon reapplication of tension to the cable, draws the pawl back into its disengaged position.

Yet another object of the present invention is to provide an upwardly-acting door having an anti-drop system that is less prone to the effects of corrosion or debris. A further object of the present invention is to provide an upwardly-acting door having an anti-drop system constructed of a polymeric material. Another object of the present invention is to provide an upwardly-acting door having an anti-drop system located away from the bottom edge of the door and placed in close relation to a stop surface preventing the entrance of debris or fluid that could corrode or otherwise interfere with the operation of the anti-drop system.

Still another object of the present invention is to provide a method of impeding the free-fall of an overhead door caused by loss of tension in a cable used in counterbalancing the door by interposing the cable between the safety stop assembly and a stop surface such that the cable, when taut, checks the biasing of the safety stop assembly and whereby a loss of tension within the cable releases the biasing force to urge the safety stop into engagement with the stop surface.

An object of alternative embodiments of the anti-drop door system of the present invention is to provide a door having a pivotally mounted pawl which is directly connected to the counterbalance cable such that tension in the cable maintains the pawl in a disengaged position relative to a stop surface, while slack in the cable permits the pawl to move to an engaged position. A further object of the alternative embodiments is to provide a stop assembly which employs a compression spring to enhance the biasing force urging the pawl toward the engaged position. Yet another object of the alternative embodiments is to realize substantially all of the above objects of the invention with fewer parts and reduced expense.

In light of at least one of the objects, the present invention contemplates a door system including a door movable between a closed vertical position and an open horizontal position, a cable interconnected to said door near the bottom thereof, the cable extending along a vertical line adjacent the door and being normally, substantially taut, and an anti-drop assembly having a pawl pivotally supported on the door, a stop surface formed adjacent the door and a spring operable to urge the pawl toward engagement with the stop surface, wherein the pawl is oriented such that it rotates in a plane passing through the cable and placed in contact therewith such that the taut cable opposes the biasing force of the spring, whereby upon the cable going slack, the spring biases the pawl into engagement with the stop surface to decelerate the door.

The invention further provides a method of impeding the free-fall of an overhead door caused by loss of tension in a cable used in counterbalancing the door comprising, providing a safety stop assembly adjacent the door adapted to selectively engage a stop surface to impede the free-fall of the door; biasing the safety stop assembly to rotate toward an engaged position with the stop surface; and interposing the cable between the safety stop assembly and the stop surface such that the cable when taut opposes the biasing of the safety stop assembly and whereby a loss of tension within the cable results in biasing of the safety stop assembly toward engagement with the stop surface.

In general, the present invention also contemplates a door system having, a door movable between a closed vertical position and an open horizontal position, a cable attached to the door and normally providing a counterbalancing force to the door, the cable extending along a vertical line adjacent the door and being normally substantially taut, and an anti-drop assembly having a pawl pivotally supported on the door and attached to the cable, a stop surface positioned adjacent to the door, and a spring operable to urge the pawl toward engagement with the stop surface, wherein when taut the cable opposes the biasing force of the spring and wherein upon the cable going slack the spring urges the pawl into engagement with the stop surface to decelerate the door.

BEST MODE FOR CARRYING OUT THE INVENTION

Figure 1:
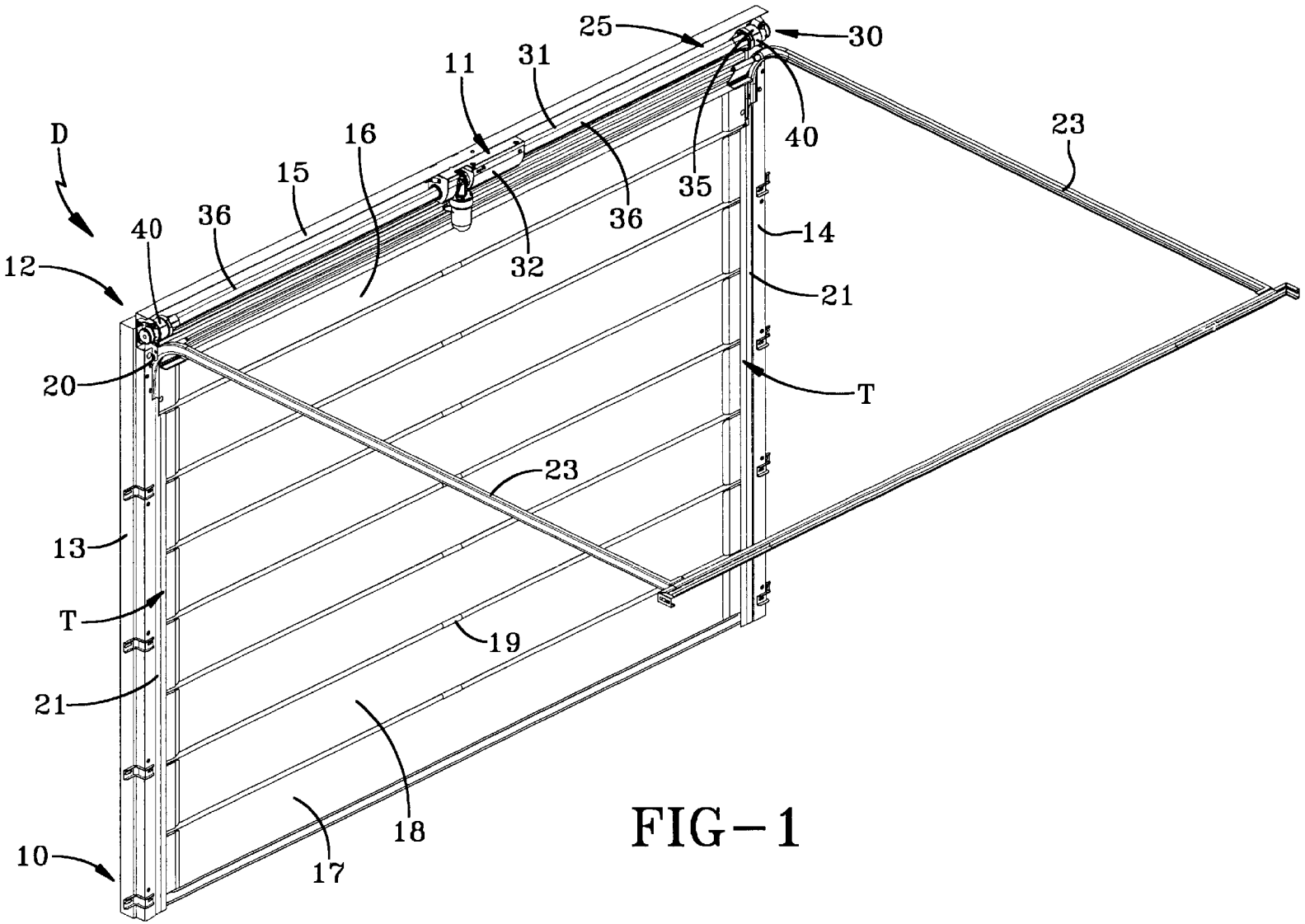
FIG. 1 is an interior perspective view of a sectional door with an anti-drop system according to the concepts of the present invention having a rotatable pawl operable with the door cable to control movement of the door upon a release of tension within the cable.

An anti-drop assembly according to the concepts of the present invention is generally indicated by the numeral 10 and is shown mounted in conjunction with a sectional door, generally indicated by the letter D, which may include an operator system, generally indicated by the numeral 11, which may be a type of jack shaft operator as employed particularly in garages for residential housing. The opening in which the door D is positioned for moving between a closed vertical position and an open horizontal position is defined by a frame, generally indicated by the numeral 12. The frame 12 consists of a pair of spaced jambs 13 and 14 that, as seen in FIG. 1, are generally parallel and extend vertically upwardly from the ground or a floor. The jambs 13, 14 are joined at their vertical upward extremity by a header 15 to thereby delineate a generally inverted U-shaped frame 12 around the opening for the door D. The frame 12 is normally constructed of wood, metal, or polymeric materials for purposes of reinforcement and facilitating the attachment of elements for supporting and controlling the door D, including the operator system 11. The door D has a top section 16, a bottom section 17, and one or more intermediate sections 18 which are interconnected by horizontally spaced hinges 19 in a manner well known to persons skilled in the art.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members having a first leg attached to an underlying jamb 13, 14 by lag bolts, or the like, and a projecting leg preferably disposed substantially perpendicular to the first leg and, therefore, perpendicular to the jambs 13, 14. A horizontal angle iron extends from the projecting leg and supports roller tracks T located to either side of door D. Tracks T provide a guide system for rollers R attached to either side of the door D, in a manner well known in the art, and generally have a vertical section 21 adjacent the door opening and a horizontal section 23 extending rearwardly of the opening. The horizontal angle irons normally extend substantially perpendicular to the jambs 13, 14 and may be attached to the transition portion of tracks T between the vertical section 21 and the horizontal section 23 thereof or at the beginning of the horizontal section of tracks T closest to the jambs 13, 14. The tracks T define the travel of the door D in moving between the closed vertical position and the open horizontal position.

The operator system 11 interrelates with the door D through counterbalance system, generally indicated by the numeral 25, which includes cable drum mechanisms, generally indicated by the numeral 30. As shown, the cable drum mechanisms 30 are positioned on a drive tube 31 which extends a substantial portion of the distance between the flag angles 20 to either side of the door D. If desired, the drive tube 31 could be constructed of two or more telescoping members to facilitate packaging, assembly, and/or adjustment. As shown, the cable drum mechanisms 30 are positioned on the drive tube 31 at the ends thereof and are in all instances nonrotatably affixed to the drive tube 31. As seen in FIG. 1, the operator system 11 may have an operator housing 32 which encloses a length of drive tube 31 that interacts with the operator drive elements (not shown) in a manner known to persons skilled in the art to selectively effect rotational drive of the drive tube 31 in both rotational directions to supply the power required for moving the door D between the closed vertical position and the open horizontal position. While drive tube 31 may be a hollow tubular member that is noncircular in cross-section, it is to be appreciated that circular drive tubes, solid shafts and other types of driving elements capable of rotating the cable drum mechanisms 30 may be employed and are encompassed within this terminology in the context of this specification.

The cable drum mechanisms 30 each include a generally cylindrical cable drum 35 which is provided, at its inboard end, with an axially projecting drum sleeve 36 which receives drive tube 31 and may be provided with a plurality of circumferentially spaced reinforcing ribs. The drum sleeve 36 is attached to the drive tube 31, as by bolts, a key, or the like such that cable drums 35 rotate with the drive tube 31. The cable drums 35 have a substantially cylindrical surface 40 provided with continuous helical grooves that receive a counterbalance cable 45 in a coiled fashion.

The counterbalance cable 45 may be of a construction commonly employed in the industry and has one extremity secured to the bottom section 17 of door D. The other end of the cable 45 is fastened to the cable drum 35, where it is looped or reeved one full turn around the cable drum 35 and through an additional, approximately ninety degree, interval before the cable 45 departs tangentially downwardly to where it is anchored to the edge cap 46 of bottom section 17 with the door D in the closed position seen in the drawings.

Under ordinary operating conditions, to raise the door D, the operator system 11 causes rotation of the drive tube 31 and accordingly cable drums 35 to wind the cable 45 about the cable drums 35. During this operation, the cable 45 is taut between the cable drum 35 and the point at which it attaches to bottom panel 17. If the cable 45 goes slack or is broken, the weight of the door D is no longer balanced by the counter balance system 25 and the door D may drop. As a result, persons or objects within the opening of door D may be struck by the falling door D resulting in serious damage or injury. To help avoid such a circumstance, the anti-drop assembly 10 acts as a stop, when tension is released from the cable 45, as now will be described.

Anti-drop assembly 10 includes a stop assembly, generally indicated by the numeral 50, that, upon release of tension within cable 45, interacts with a stop surface, generally indicated by the numeral 47, which may be made integral with the jamb 13 or the track T, to provide a stopping force against the free fall of door D. To provide a positive stop, as opposed to relying on frictional forces generated between the stop assembly 50 and stop surface 47, the stop surface 47 may include a surface 48 normal to the direction of the falling door. This surface 48 may extend outward in the form of a projection or be an edge of a notch 49 formed in stop surface 47 as shown.

Figure 2:
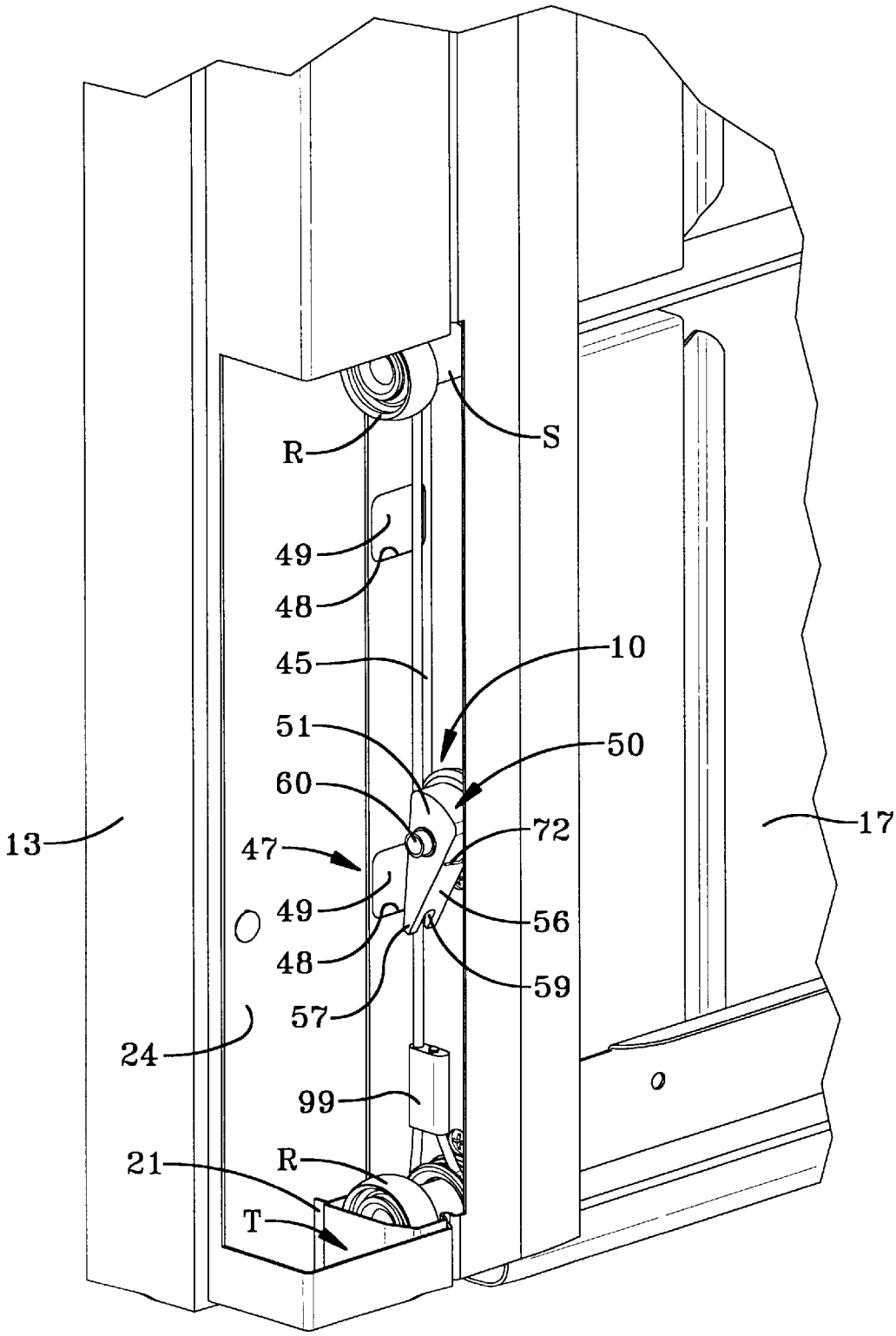
FIG. 2 is an enlarged fragmentary perspective view of a portion of FIG. 1 depicting the anti-drop system on the left side of a door as seen in FIG. 1 showing details of the interrelation of the cable and pawl in the anti-drop system.

Stop assembly 50 also includes a pawl 51 which, as will hereinafter be described, is rotatable to engage one or more notches 49. Pawl 51 may generally be of any shape capable of engaging the stop surface 47 including the wedge shape shown. In the embodiment shown, the pawl 51 has opposed planar faces 56 converging at a flattened tip 57. The tip 57 provides a stopping surface oriented to engage the surface 48 of notch 49. The tip 57 of pawl 51 may be provided with a cutout or notch 59 for receipt of cable 45 therethrough. As a result, stop assembly 50 is located proximate to cable 45 such that the tensioned cable 45 holds the pawl 51 in its unlocked position (FIG. 2).

The pawl 51 may be supported on door D by a generally planar mounting bracket, generally indicated by the numeral 61. To avoid interference with the operation of door D, mounting bracket 61 may be profiled to fit within the boundaries of the end cap 46 of bottom panel 17. Mounting bracket 61 may be attached to the bottom panel 17 directly or to end cap 46, as by cap screws 53, 54. Cap screws 53, 54 may be driven into countersunk receivers 63 formed in the face 58 of bracket 61, which may be aligned with openings 62 in end cap 46.

A pivot member, generally indicated by the numeral 60, extends axially outward from mounting bracket 61 to receive pawl 51. Pawl 51 is provided with a bore 64 to receive pivot member 60, such that pawl 51 may rotate about pivot member 60. Pivot member 60 may include a concentrically recessed tip 65 that extends axially toward track T beyond the pawl 51, when the pawl 51 is installed. Further, the base 66 of pivot member 60 may be provided with an annular gusset 67 to reinforce pivot member 52 and space pawl 51 from face 58 to avoid binding therebetween.

Figure 3:
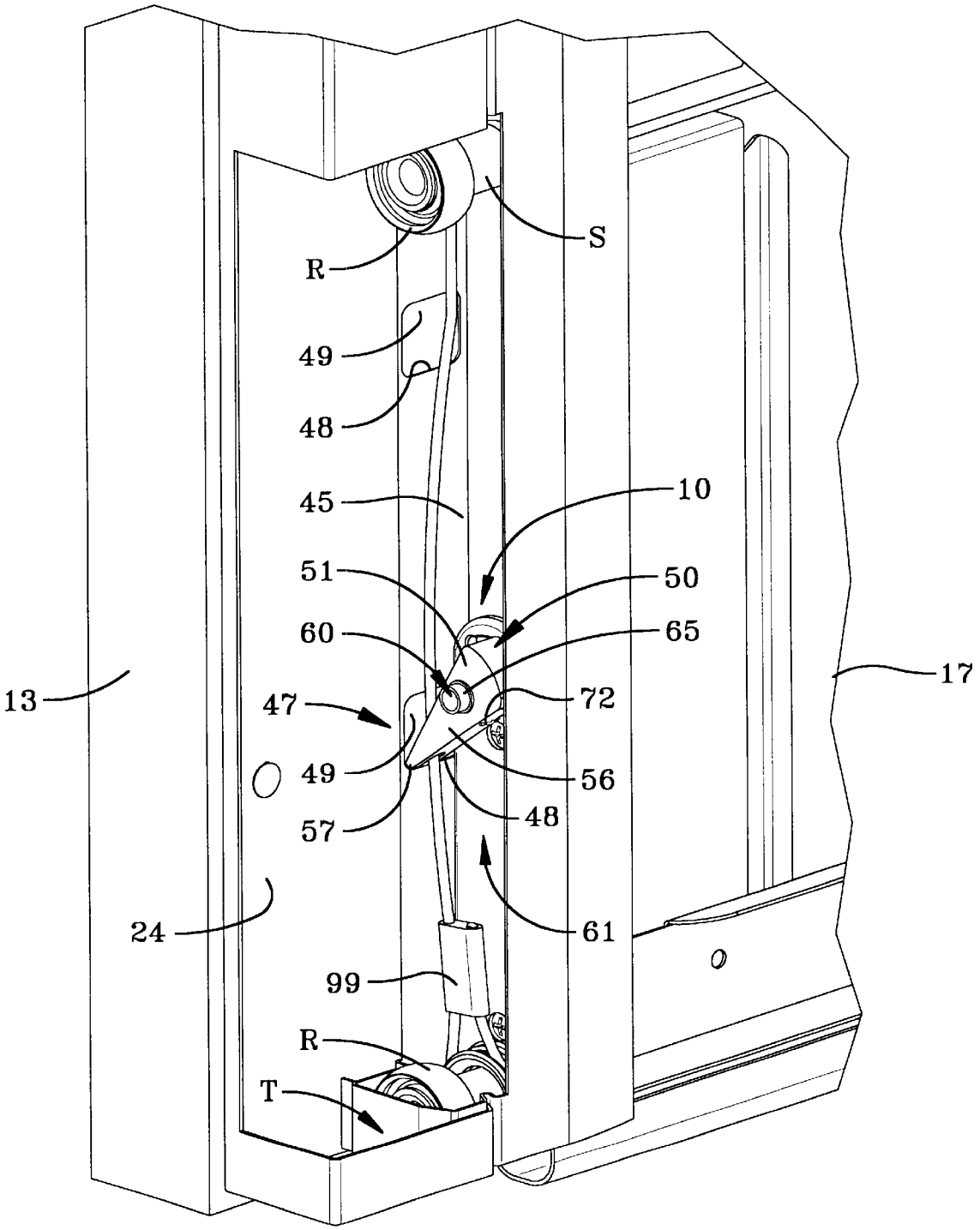
FIG. 3 is an enlarged fragmentary perspective view depicting the anti-drop system in an engaged position showing a slack cable that no longer resists the biasing force applied to the pawl allowing the pawl to rotate into engagement with a stop surface aligned perpendicular to the cable.
Figure 5:
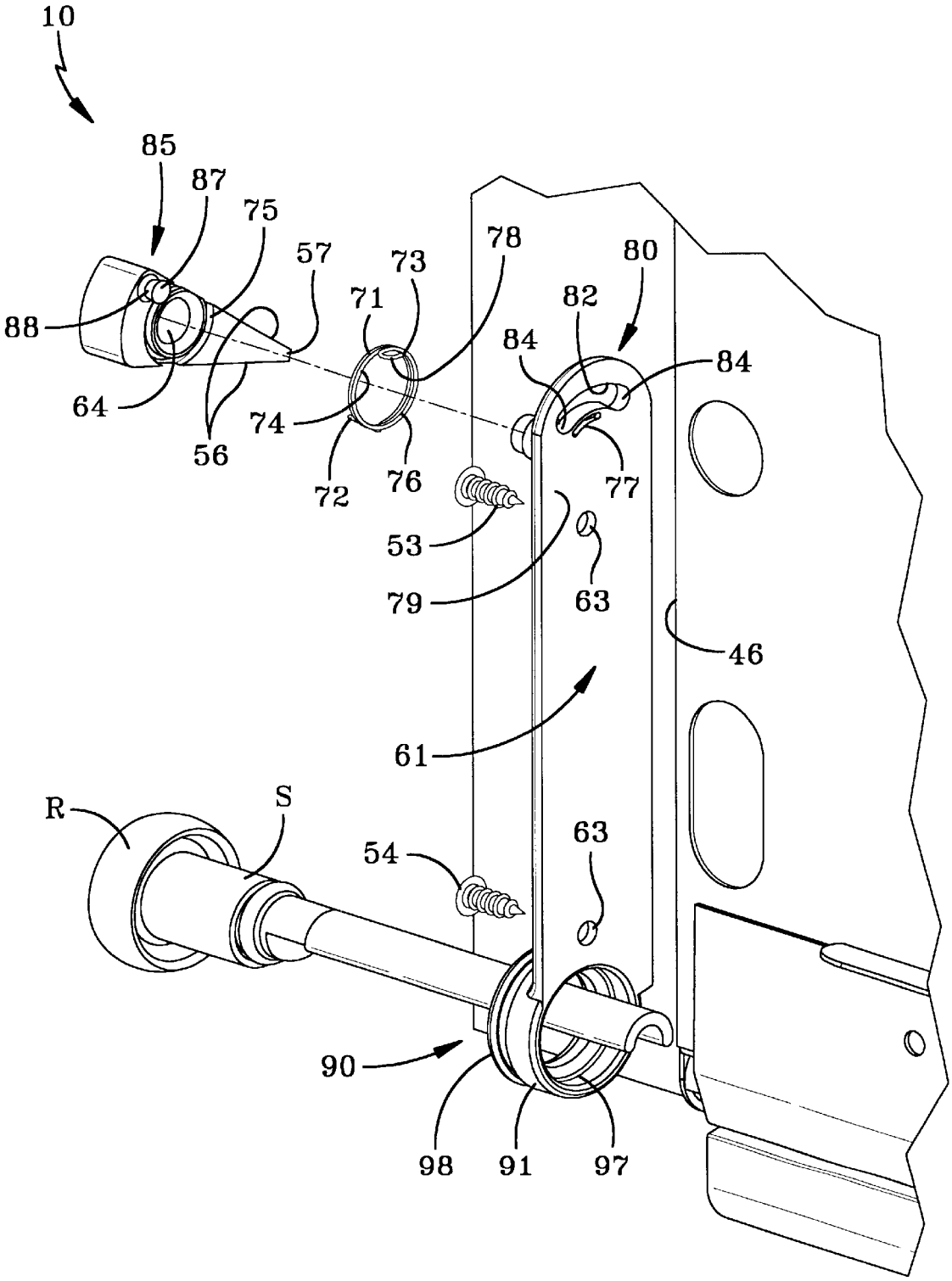
FIG. 5 is an enlarged fragmentary exploded view similar to FIG. 4 but rotated 180° to show additional details of the anti-drop system.
Figure 6:
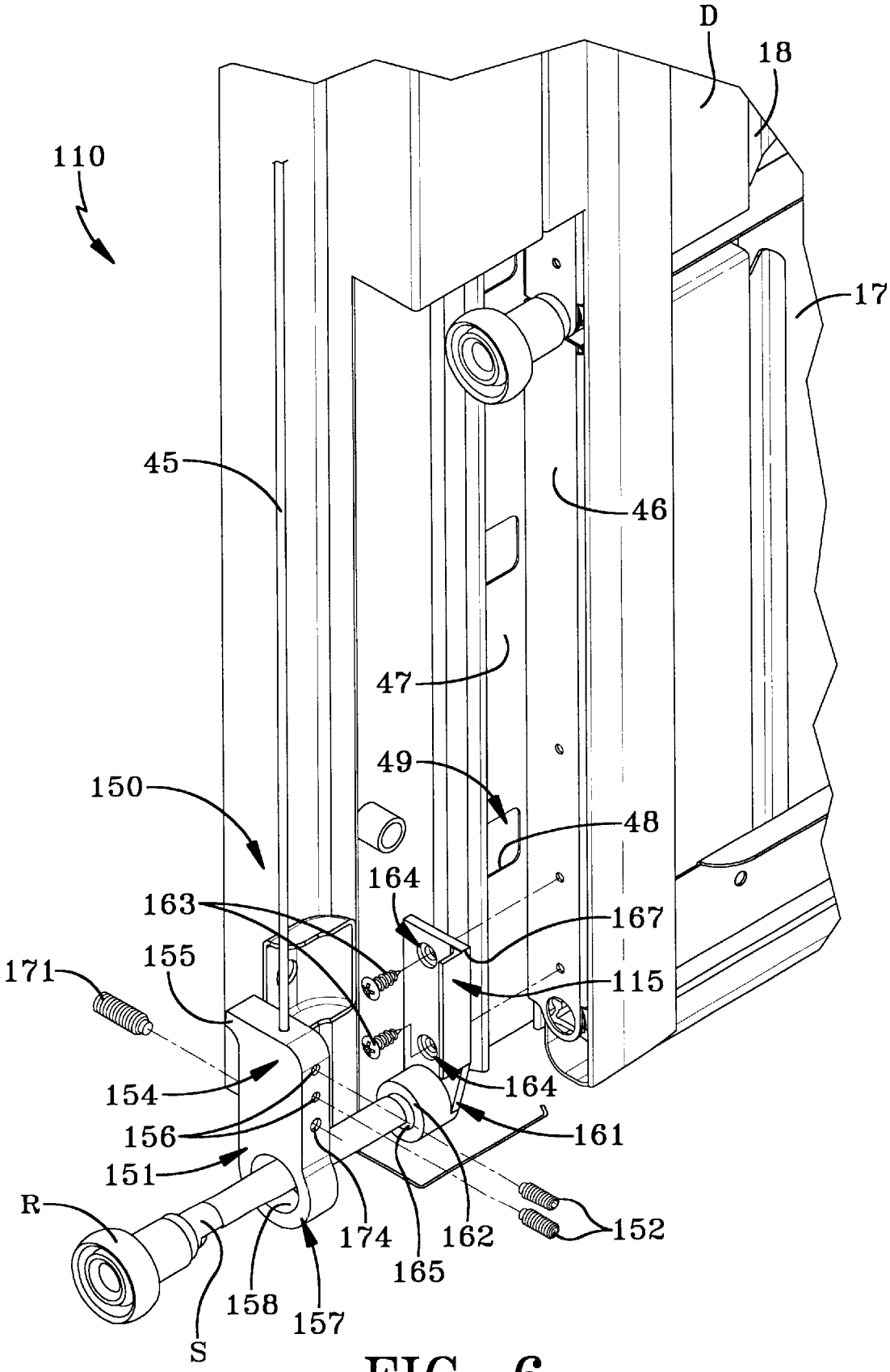
FIG. 6 is an enlarged fragmentary exploded perspective view similar to FIG. 2 depicting an alternative anti-drop assembly on the left side of a door as seen in FIG. 1 with a portion of the jamb cut-away to show details of the anti-drop assembly.
Figure 7:
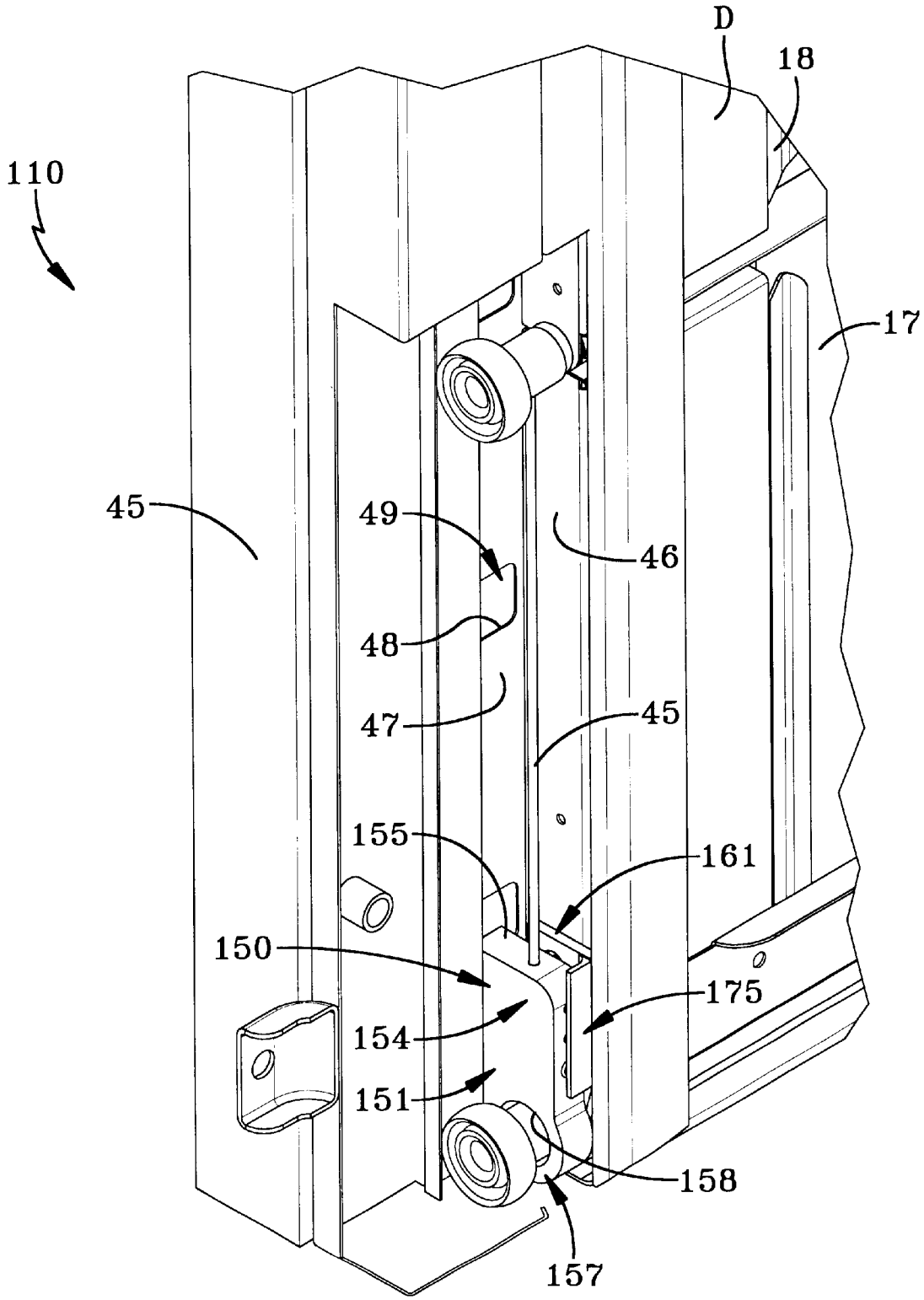
FIG. 7 is an enlarged fragmentary perspective view depicting the anti-drop assembly of FIG. 6 attached to a cable of the counterbalance system and held by the cable in a disengaged position.
Figure 8:
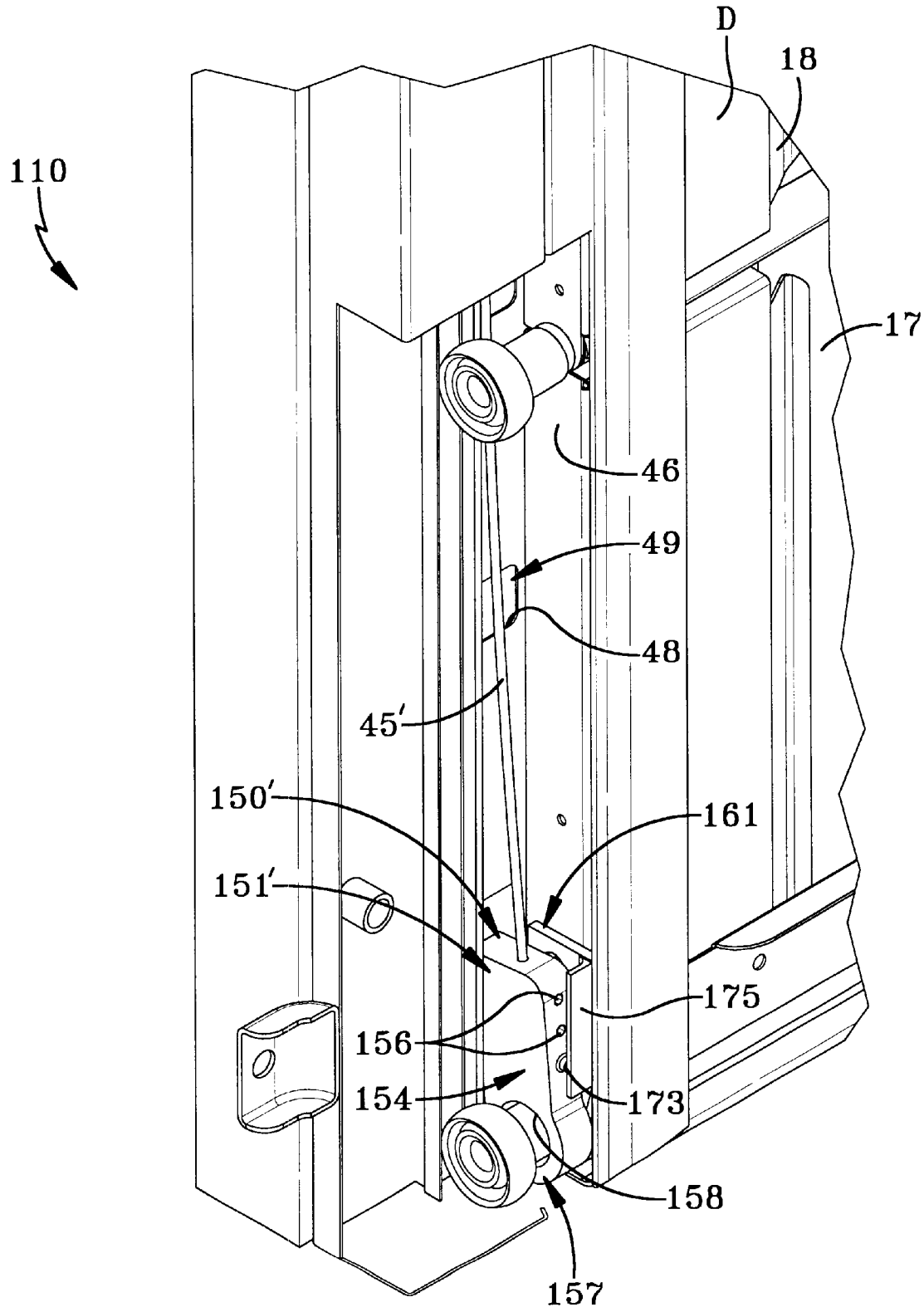
FIG. 8 is an enlarged fragmentary perspective view similar to FIG. 7 depicting a slack cable and the anti-drop assembly in an engaged position.

A biasing assembly, generally indicated by the numeral 70, may be operatively interconnected with the pawl 51 and mounting bracket 61 to bias pawl 51 toward an engaged position (FIG. 3). The biasing assembly 70 may include a coil spring 71 having a first end 72 and a second end 73, where coil spring 71 defines an opening 74 sized to fit over pivot member 60. First end 72 extends in the axial direction generally perpendicular to the coils 76 of spring 71 to engage pawl 51. As best shown in FIG. 5, pawl 51 is provided with an annular recess 75 to receive the coils 76 of spring 71 with the first end 72 being subjacent to the pawl 51. The second end 73 of spring 71 extends in the axial direction toward mounting bracket 61 and is received within a slot 77 formed with the mounting bracket 61. Second end 73 may be provided with a catch 78, as by bending it to form a hook-like end on second end 73, to engage the rear surface 79 of mounting bracket 61. To install spring 71, the catch 78 is inserted axially through the appropriately sized slot 77, and then rotated until the catch 78 lies adjacent to the rear surface 79 of mounting bracket 61. In this way, catch 78 would help resist axial movement of the spring 71 that might cause it to come free of the mounting bracket 61. In a manner known to those skilled in the art, relative displacement of the first and second ends 72, 73 causes the spring 71 to exert a biasing force that urges the pawl 51 toward the locked position (FIG. 3).

Figure 4:
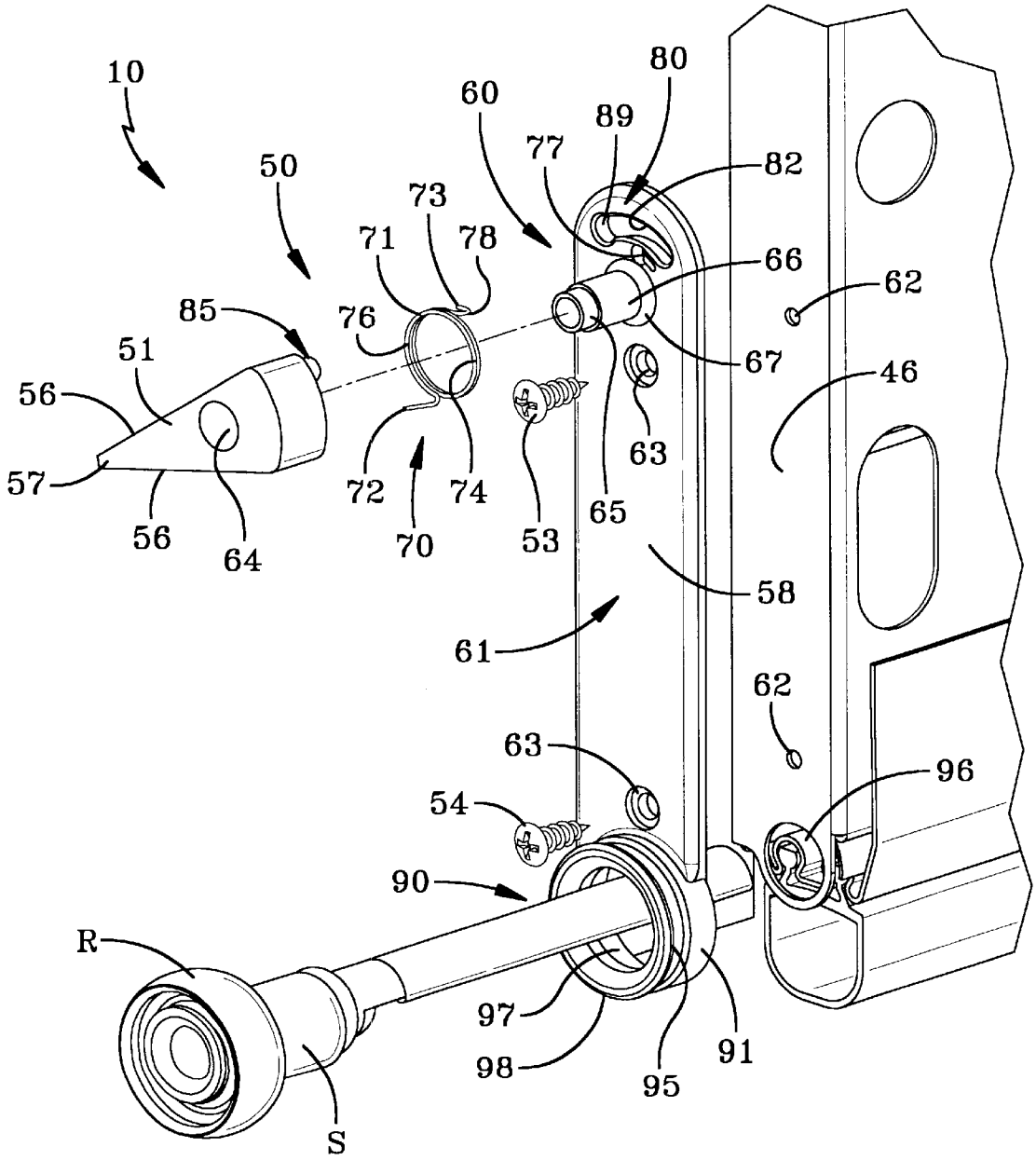
FIG. 4 is an enlarged exploded fragmentary perspective view of the bottom section of a door as seen in FIG. 1 depicting further details of the anti-drop system shown in FIG. 2.

When installed, spring 71 is pre-tensioned by rotating pawl 51 away from the engaged position. Cable 45 is interposed between the pawl 51 and the track T and secured to the bottom panel 17 of the door D. With the cable 45 taut (FIG. 2), the force of spring 71 is checked by the cable 45. If tension is released from the cable 45 causing it to go slack (FIG. 3), the spring 71, unchecked, urges the pawl 51 toward the locked position (FIG. 3). To limit the range of motion of pawl 51, a guide assembly, generally indicated by the numeral 80, may be provided. Guide assembly 80 generally includes a guide surface that interacts with at least a portion of pawl 51 to restrict its movement. As best shown in FIG. 4, the guide surface may be made part of a slot 82 formed within the mounting bracket 61. The ends 84 of slot 82 act as stops to the rotation of pawl 51. To interact in this fashion with slot 82, a projection, generally indicated by the numeral 85, extends from pawl 51 toward slot 82. When the pawl 51 is installed on pivot member 60, at least a portion of projection 85 rests within the confines of slot 82 such that contact between the ends 84 and projection 85 act to limit the motion of pawl 51. To allow for the curvilinear motion of the projection 85, slot 82 is made arcuate and tracks an arc length corresponding to the desired degree of rotation for pawl 51.

The base 87 of projection 85 is made larger than the body 88 of projection 85 such that the base may be snap-fit to the mounting bracket 61 at a selected point within slot 82 such as an entry portion 89 (FIG. 4) of slot 82 sized to receive base 87. Entry portion 89 is located at the end 84 closest to the forward edge of track T. The remaining portion of slot 82 is sized to conform to the dimensions of body 88 such that, while within this portion, the base 87 may not move axially outward toward pawl 51 resulting in inadvertent axial release of the pawl 51.

Figure 2A:
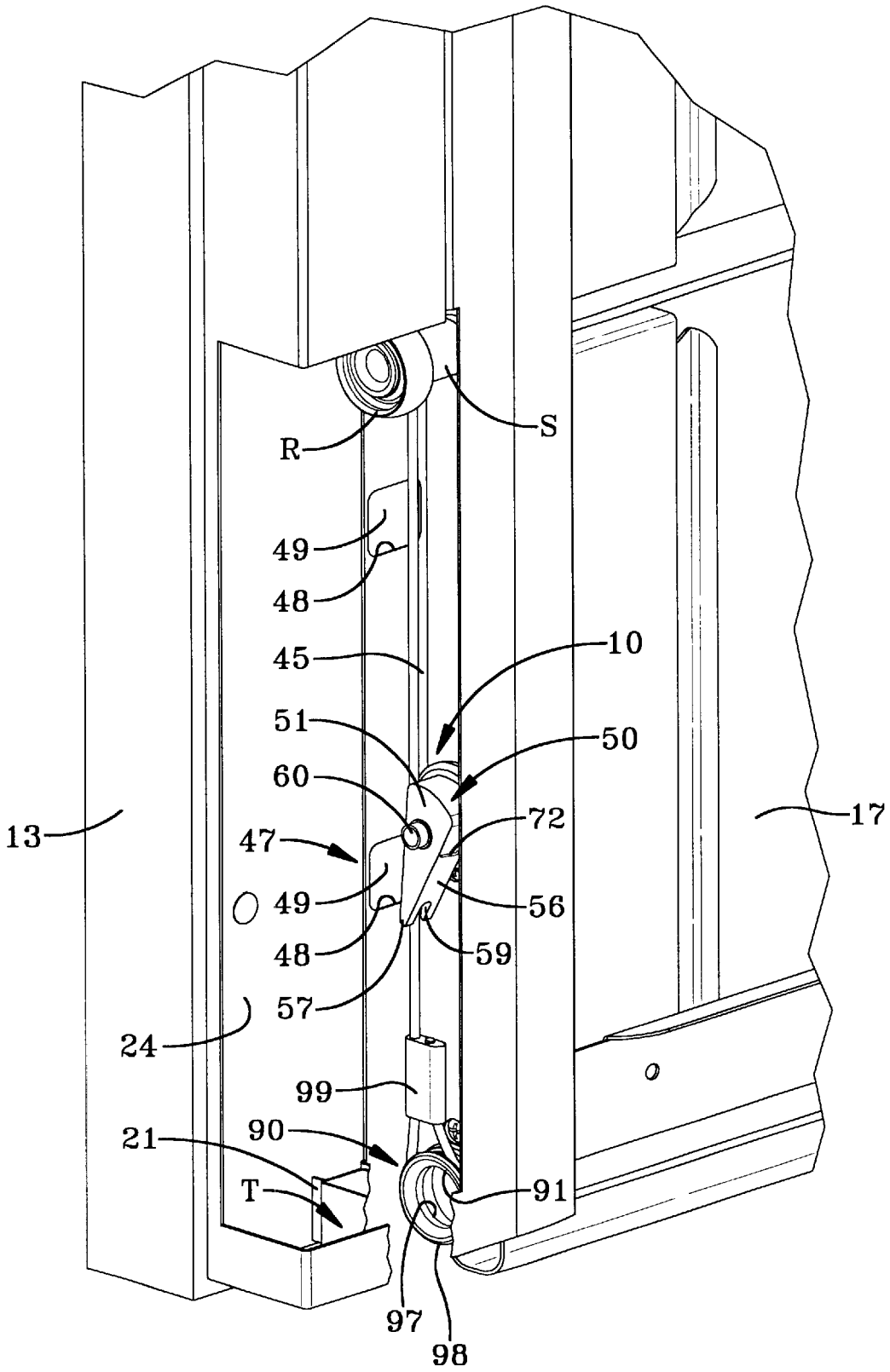
FIG. 2A is an enlarged fragmentary perspective view similar to FIG. 2 with a portion of the jamb cut away and the roller removed to show details of the attachment of the cable to the lower part of the door.

Thus, to assemble pawl assembly 50, as shown in FIGS. 4 and 5, spring 71 is located within recess 75 with the first end 72 of spring 71 lying beneath pawl 51. The pawl 51 is slipped over pivot member 60 and aligned such that the second end 73 of spring 71 may be inserted within slot 78. Then, pawl 51 may be rotated counterclockwise tensioning the spring 71 and locating projection 85 to be inserted through entry portion 89. So located, projection 85 may be snapped into place. With the pawl 51 attached, cable 45 is interposed, as described, to hold the pawl 51 in an unlocked position (FIG. 2). As shown in the drawings, as an alternative to a conventional attachment of the cable 45 to door D, mounting bracket 61 may be provided with a cable attachment assembly, generally indicated by the numeral 90. Cable attachment assembly 90 includes an attachment member 91 that preferably aligns the cable 45 with the pawl 51 to ensure that the cable 45, when taut, checks the pawl 51 preventing it from attaining the locked position. Cable receiving notch 59 at the tip 57 of the pawl 51 helps maintain this alignment. In the embodiment shown, attachment member 90 is provided with a recess 95 aligned with notch 59 such that the cable 45 extends in a straight line from notch 59 to recess 95. Attachment member 91 is located coaxially with an opening 96 in bracket 46 where roller R attaches to the bottom panel 17. To apply force generated by the operator 11 below roller R, attachment member 91 is made annular providing an aperture 97 through which the shaft S of roller R may be inserted. As best shown in FIG. 2A, cable 45 is extended around the lower portion 98 of attachment member 91 within recess 95 and then tied off, as by a clasp 99. Thus, when the operator 11 is activated to raise the door D, tension on cable 45 is applied to the attachment member 91 and communicated to the bottom panel 17 of door D via screws 53, 54 or shaft S.

It will be appreciated that when the door D is in the closed position, the cable 45 may be slack allowing the pawl 51 to rotate to the locked position. As tension is reapplied to the cable 45, the pawl 51 is urged toward the disengaged position, by cable 45, automatically resetting pawl 51 for uninhibited operation of the door D. Consequently, as the door D is opened and closed, the pawl 51 and its related components are cycled between the locked and unlocked positions helping to reduce the amount of corrosion, dust, or debris that would ordinarily build up on these members when left stationary. To stop the door D from unintended free-fall, pawl 51 interacts with stop surface 47 which, upon contact with pawl 51, applies a force opposite to the direction of the door's travel. The stop surface 47 is generally located proximate to stop assembly 50 to allow interaction therebetween and runs parallel to the track T. Stop surface 47 may be provided on jambs 13 or 14 having notches 49. The notches 49 may have rectangular openings in which the pawl 51 may enter. The lower surfaces 48 of the notches 49 are preferably generally perpendicular to the direction of travel of the door D and the tip 57 of pawl 51. As shown in the figures, the notches 49 may be periodically spaced along the jambs 13, 14 to provide a number of stop points thereon. While the stop surface 47 may conventionally be constructed of wood or metal, polymeric materials may alternatively be used to provide a somewhat forgiving surface that would cushion contact between the pawl 51 and stop surface 47. Likewise, the pawl 51 may be partially or entirely constructed of similar polymeric material. In addition to being more resistant to corrosion, the frictional characteristics of these materials may help slow the descent of the door D when the pawl 51 is contacting the jambs 13, 14 or stop surface 47 between inset portions 49.

An alternative anti-drop assembly 110 including a stop assembly, generally indicated by the numeral 150, is shown in FIGS. 6-12. Stop assembly 150 is similar to stop assembly 50 in that it pivots to engage stop surface 47 and thereby decelerate a free-falling door D. Stop assembly 150 operates in generally the same basic manner as stop assembly 50. Specifically, upon release of tension within cable 45, stop assembly 150 interacts with stop surface 47 to provide a stopping force against free-fall of door D. Stop assembly 150 may further interact with a surface 48 normal to the direction of falling movement of door D to provide a positive stop to the free-fall of the door D. To that end, stop assembly 150 includes a pawl 151 pivotally mounted on the door D and attached to cable 45.

Figure 11:
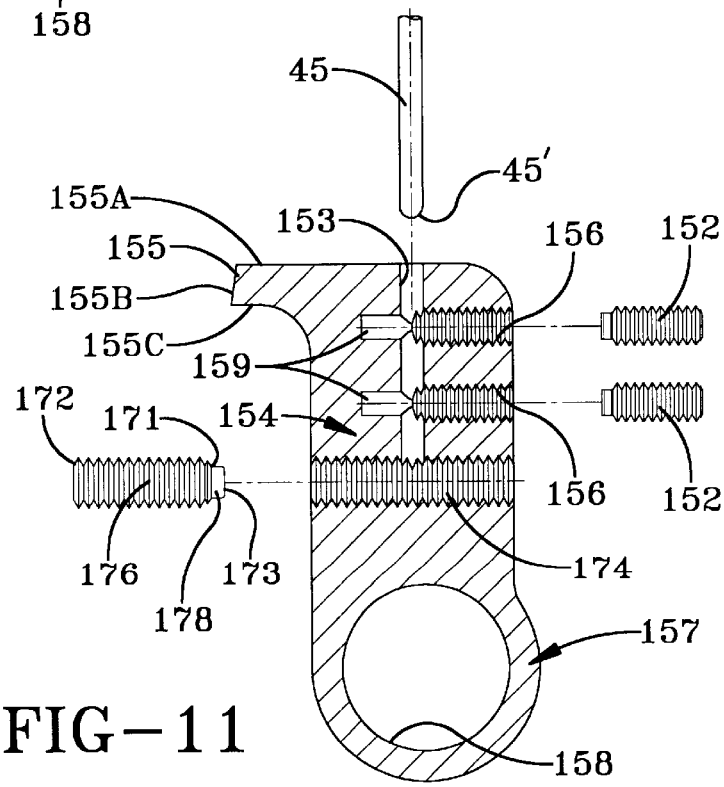
FIG. 11 is a partially cut-away partially exploded side elevational view of the pawl depicted in FIG. 10 shown with a fragmentary portion of a counterbalance cable to depict details of the attachment of the cable to the pawl.
Figure 12:
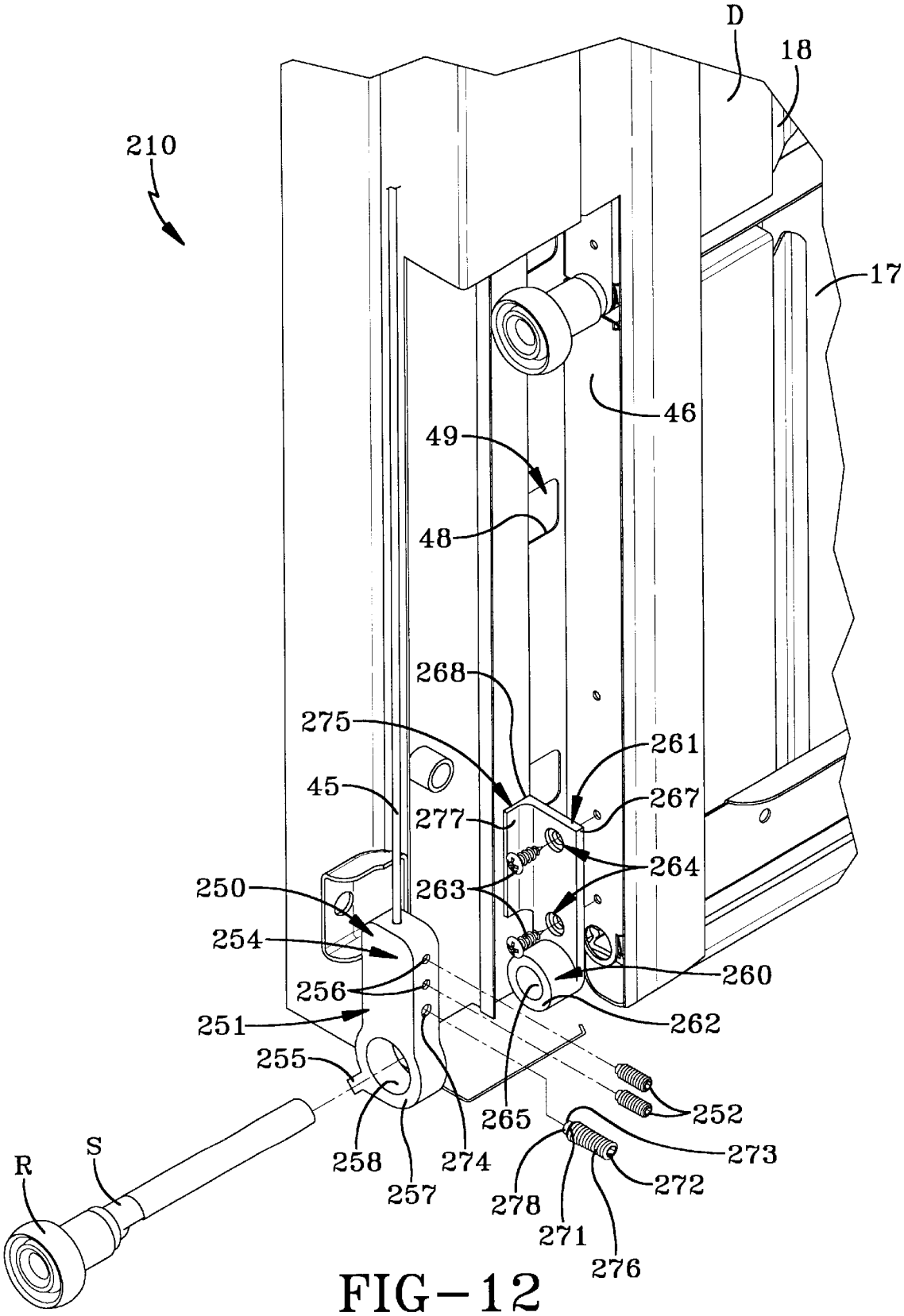
FIG. 12 is an enlarged exploded fragmentary perspective view of another alternative anti-drop assembly on the left side of a door as seen in FIG. 1 with a portion of the jamb cut-away to show details of the anti-drop assembly.
Figure 13:
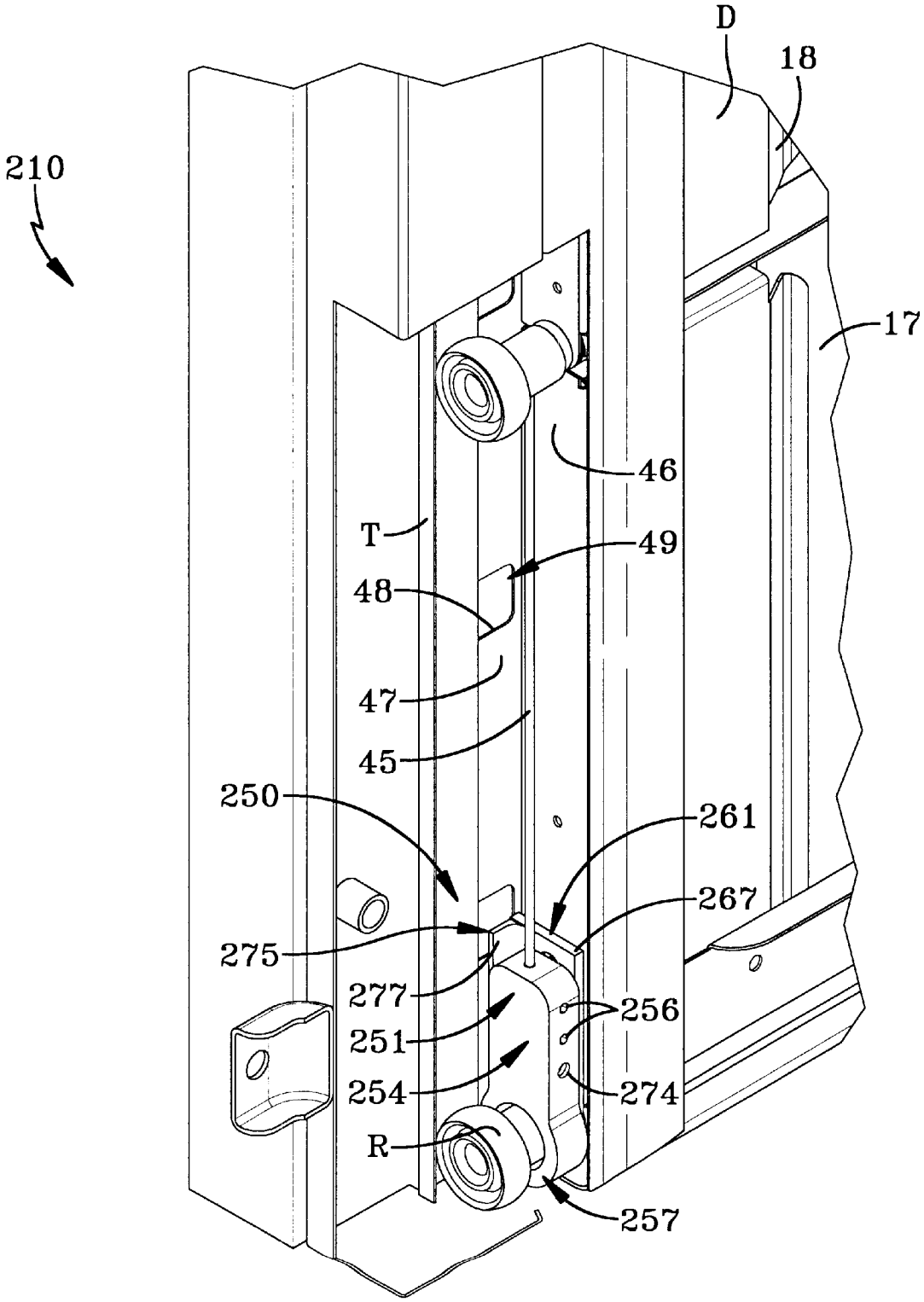
FIG. 13 is an enlarged fragmentary perspective view depicting the anti-drop assembly of FIG. 12 attached to a cable of the counterbalance system and held by the cable in a disengaged position.
Figure 14:
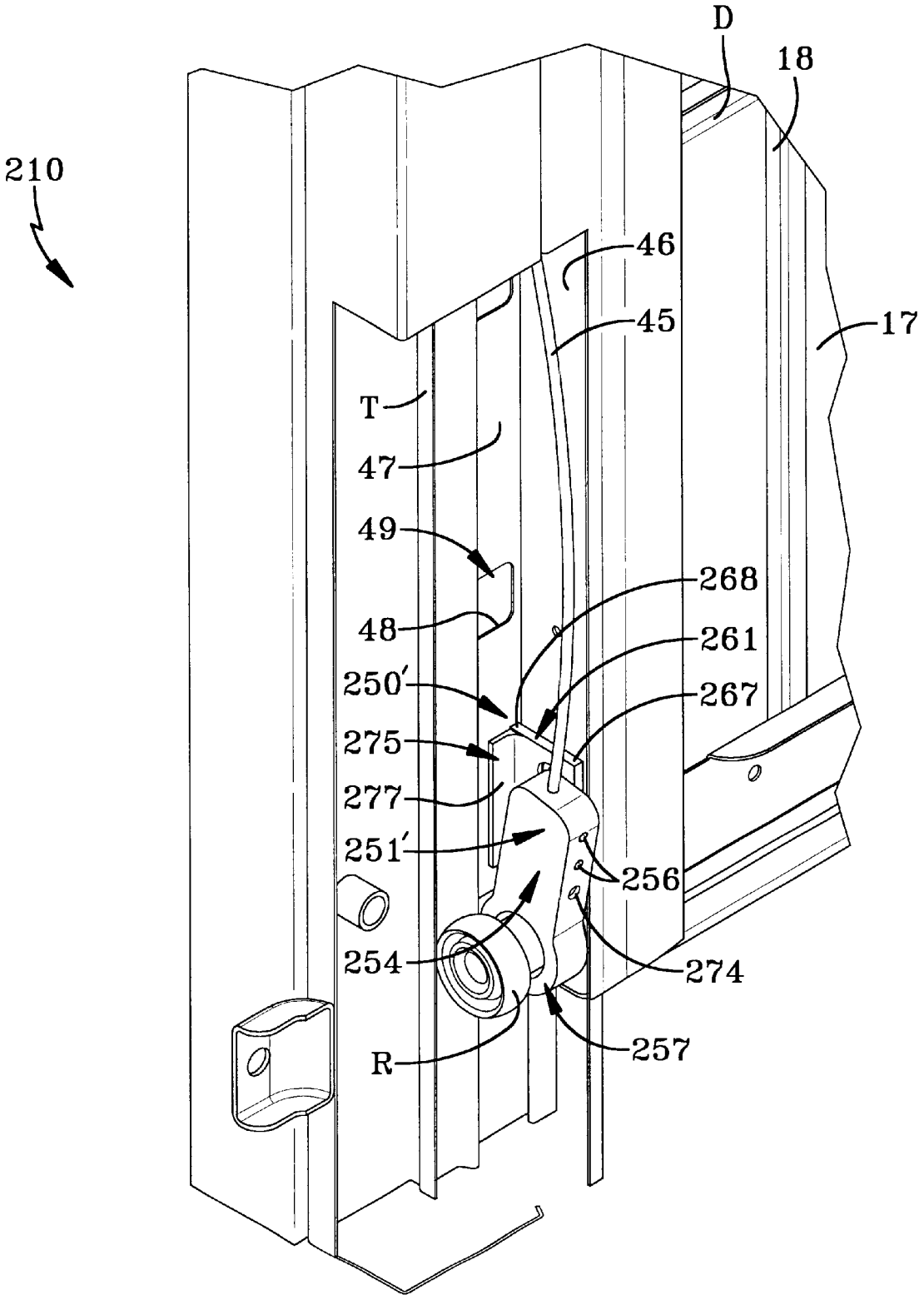
FIG. 14 is enlarged fragmentary perspective view, similar to FIG. 13 depicting a slack cable and the anti-drop assembly in an engaged position.

The cable 45 may be attached to the pawl 151 in any suitable manner, including the use of a hook, loop, or fasteners, such as, for example, by a pair of screws 152, 152, that act to clamp the cable 45 to the body 154 of pawl 151. In this example, as best shown in FIG. 11, the body 154 of pawl 151 may have a pair of threaded bores 156, 156 that open into a cable bore 153 extending downwardly into the body 154 of pawl 151, such that, a length proximate the end 45' of cable 45 is in registry with bores 156, 156. To secure the end of cable 45, screws 152, 152 are threaded into bores 156, 156 extending into cable bore 153 until sufficient clamping force is applied to the cable 45 to hold it within the cable bore 153. To facilitate clamping, studs 159, 159 may be provided in opposed relation to the bores 156, 156 and protrude into cable bore 153, such that, the screws 152, 152 move into proximity with respective studs 159, 159 clamping the cable 45 therebetween. As shown, studs 159, 159 may taper inwardly at their exposed extremity to better grip and/or penetrate cable 45, to effect clamping. With the cable 45 attached to pawl 151, the counterbalancing force of the cable 45 is applied to the door D via pawl 151.

The pawl 151 is provided with a projecting head 155 that extends outwardly from the body 154 of pawl 151 toward the stop surface 47. Projecting head 155 may have any of a variety of shapes, including the rectilinear tab-like form shown. In the embodiment shown in FIGS. 9–11, head 155 has generally parallel sides extending outward from the pawl 151 and a flattened tip 155B which may extend at an outward angle from the top 155A to the bottom 155C of the head 155, as shown. Tension on the attached cable 45 acts to hold the pawl 151 in a generally vertical disengaged position 150 (shown in chain lines in FIG. 9), where the projecting head 155 is clear of the stop surface 47. When tension is released from the cable 45, pawl 151 is permitted to rotate toward an engaged position 150', where head 155 engages the stop surface 47, as described more completely below.

To provide for rotatable attachment of the pawl 151 to the door D, pawl 151 is provided with a pivot portion, generally indicated by the numeral 157, that is pivotally attached to the door D. Pivot portion 157 may define a pivot bore 158 to rotatably mount pawl 151 on a pin, boss or other suitable pivot member, generally indicated by the numeral 160.

In the embodiment shown, a mounting bracket, generally indicated by the numeral 161, carries pivot member 160, which, in the example shown, is in the form of a cylindrical boss 162 that extends axially outward of the edge of the door D. As shown, boss 162 may be formed on the plate-like mounting bracket 161 near the bottom thereof. The mounting bracket 161 may be attached to the door D, as by cap screws 163, 163 that are driven into the end stile 46 of the door D through countersunk receivers 164, 164 in the mounting bracket 161. The pivot bore 158 of pawl 151 fits over the boss 162 and the cylindrical surfaces of the boss 162 and bore 158 are sized to provide sufficient clearance for the free rotation of the pawl 151 on the boss 162. To facilitate such rotation, a lubricant may be applied to the surfaces or a self lubricating material may be used to form the pawl 151 and/or boss 162.

Figure 9:
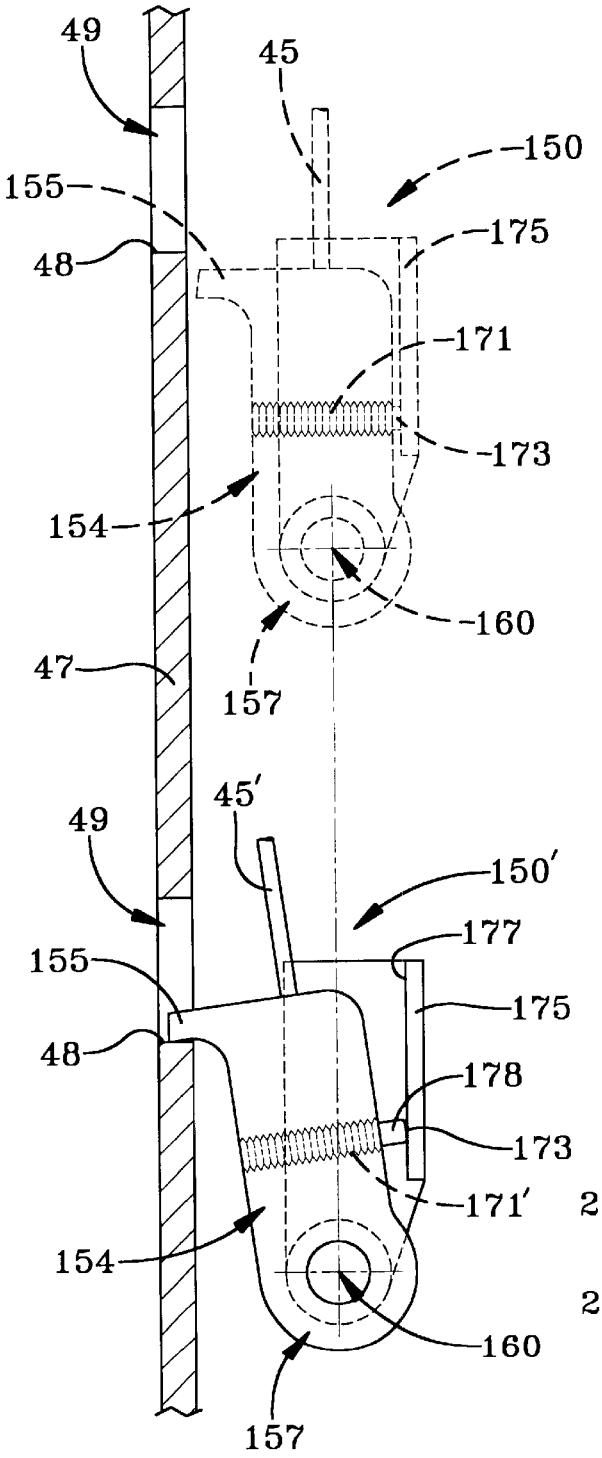
FIG. 9 is a partially schematic partially cut-away side elevational view depicting operation of the alternative anti-drop assembly shown in FIG. 6 showing particularly a disengaged position of a pawl in broken lines and positive contact between the pawl and a stop surface in solid lines.

Boss 162 may be made annular defining a roller bore 165 adapted to receive the shaft S of a roller R for supporting the roller R within bracket 161, as discussed in detail in the previous embodiment. The center of the pivot bore 158 and boss 162 may be located rearwardly of the cable 45 (FIG. 9) to provide the pawl 151 with a predisposition to move toward the engaged position under the force of gravity, for example, when tension is released from the cable 45. To provide reliable contact upon release of tension from the cable 45, a biasing assembly, generally indicated by the numeral 170 is operatively interrelated with the pawl 151 to bias the pawl 151 toward an engaged position 150' (FIG. 9). The biasing assembly 170 may include a compression spring 171, or other spring arrangement such as a leaf spring, coil spring, tension spring, or detent spring. A ball plunger is depicted in the illustrated embodiment and includes a casing 176 and a spring-loaded plunger 178 housed within the casing and extendable externally thereof.

Figure 15:
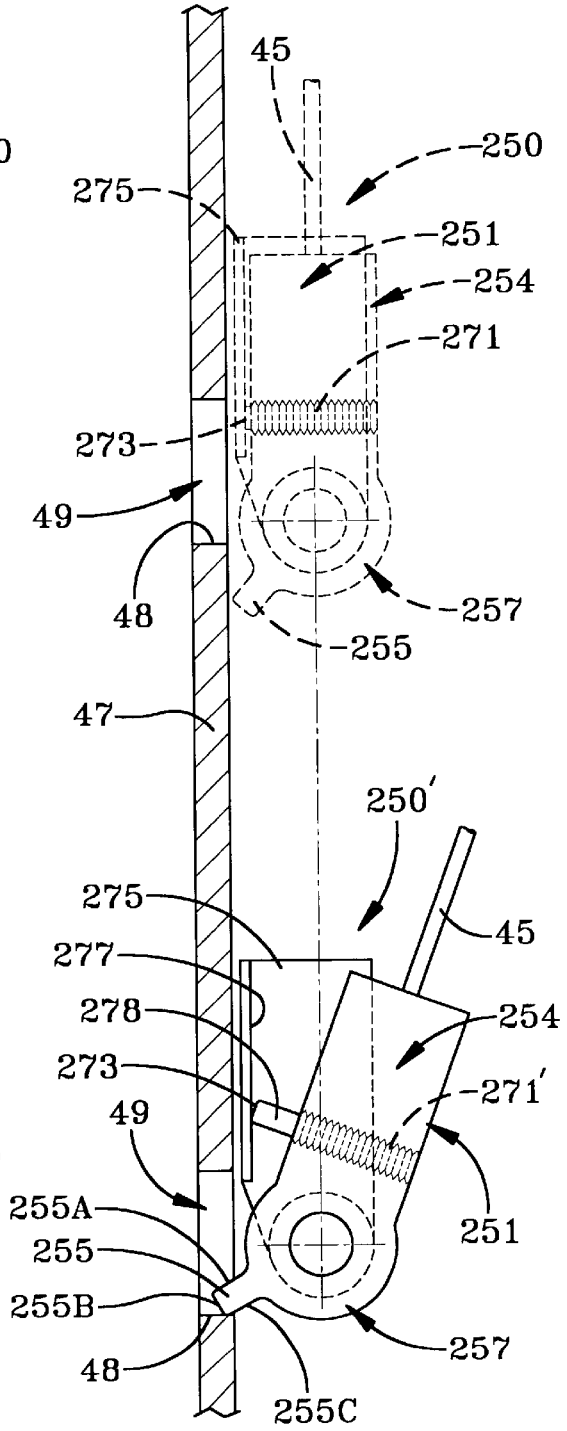
FIG. 15 is a partially schematic partially cut-away side elevational view of the alternative anti-drop assembly shown in FIG. 12, depicting a disengaged position of a pawl in broken lines and positive contact between the pawl and a stop surface in solid lines.

In the illustrated embodiment, spring 171 has a first end 172 and a second end 173, with spring 171 generally held within an internally threaded spring receiving bore 174 defined within the body 154 of the pawl 151 engaging threads on the casing 176. The first end 172 is insertably received within the pawl 151 and the second end 173 selectively contacts a keeper 175, which may be formed on the door D or mounting bracket 161. Keeper 175 is a surface against which spring 171 may bear, and may be, as shown, a planar member extending adjacent to pawl 151, as described more completely below. In the embodiment shown, the spring 171 is compressed between the keeper 175 and pawl 151, when the pawl 151 is held in the upright generally vertical disengaged position by the tension of cable 45. If tension is released from the cable 45, the spring 171 expands urging the head 155 of pawl 151 toward the stop surface 47. In the embodiment shown in FIG. 9, for example, the pawl 151 is driven in a counterclockwise fashion toward the stop surface 47 such that the projecting head 155 is urged into engagement with stop surface 47. As will be appreciated, the locking assembly 150 may be alternatively configured to rotate in a clockwise fashion, as shown in FIG. 15, and described more completely below. Also, it will be appreciated that a spring 171 may be configured to operate to the same effect in tension.

Figure 10:
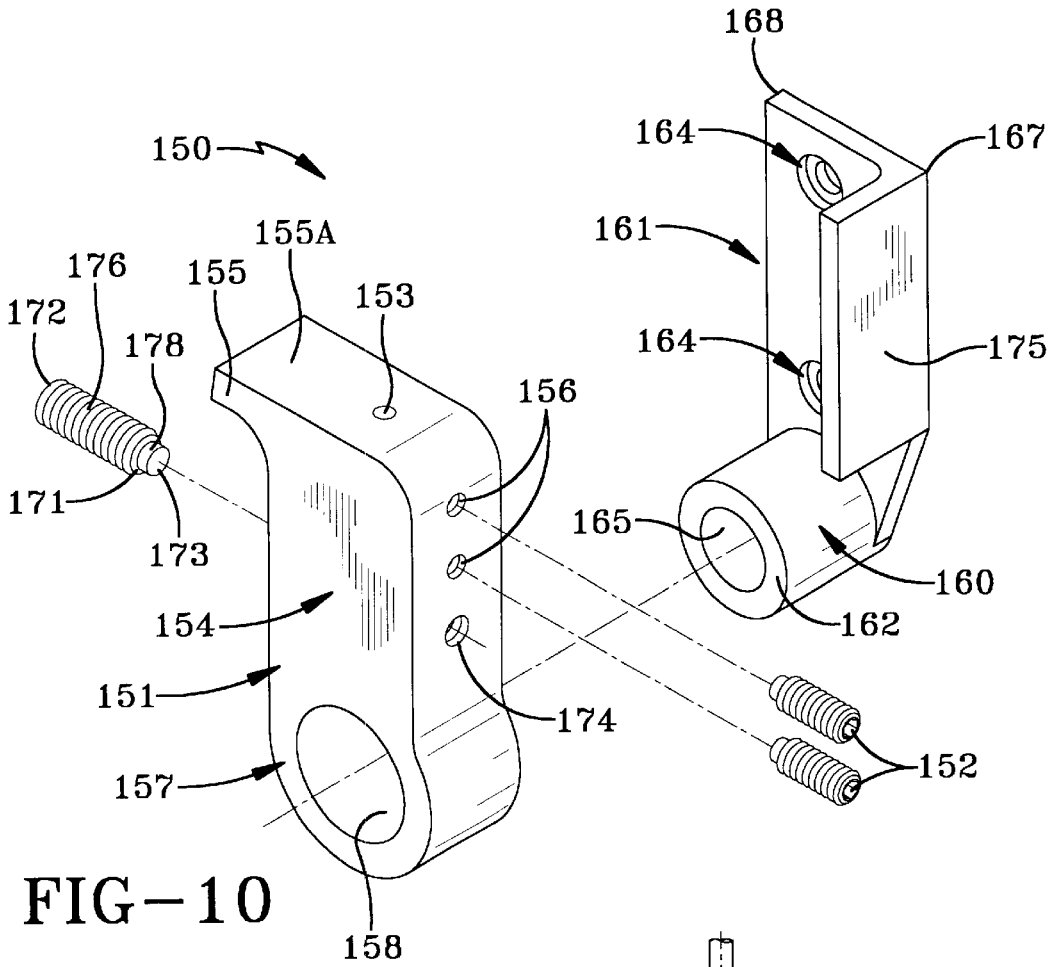
FIG. 10 is an exploded perspective view of a pawl and mounting bracket of the alternative anti-drop assembly depicted in FIG. 6.

In the embodiment shown in FIG. 9, keeper 175 extends laterally outwardly from the rear edge 167 of mounting bracket 161 and is oriented generally parallel thereto. Keeper 175, in this example, takes on the form of a generally planar vertically extending flat member having a length that generally coincides with the length of the body portion 154 of the pawl 151, thereby providing a suitable clearance below keeper 175 for rotation of the pivot portion 157 of the pawl 151. Keeper 175 extends outwardly from the mounting bracket 161 a sufficient distance to provide a surface 177, which faces spring 171, against which the second end 173 of the spring 171 may bear. As best shown in FIG. 10, surface 177 may extend substantially the entire width of the body portion of the pawl 151. Thus, the first end 173 of spring 171 may apply force to the keeper 175 that acts to urge the pawl 151 away from keeper 175 causing the pawl 151 to rotate about pivot 160, such that, head 155 is driven toward stop surface 47. In the example shown, the spring force is applied to the body portion 158 of pawl 151 at a point above the pivot 160. As tension is released from the cable 45, the force of spring 171 overcomes the maintaining force of cable 45 and urges the pawl 151 forward. Thus, in the event of an abrupt release of tension within cable 45, the spring 171 urges the projecting head 155 into engagement with the stop surface 47. Also, as the door D is raised to the horizontal open position, tension is gradually released from the cable 45 and the pawl 151 is permitted to rotate to some extent under the force of the spring 171, and, thus, the pawl 151 is regularly rotated during normal operation of the door D to prevent the build-up of dust, debris or corrosion. It will be appreciated that the stop surface 47 extends within the vertical track members 16 and, thus, release of tension on the pawl 151 in the horizontal open position does not interfere with operation of the door D.

Another alternative anti-drop assembly is shown in FIGS. 12–15 and is generally indicated by the numeral 210. Anti-drop assembly 210 includes a stop assembly, generally indicated by the numeral 250, similar to the previously described stop assembly 150. In this embodiment pawl 251 is configured to rotate in a clockwise manner to engage the stop surface 47. To that end stop assembly 250 differs from stop assembly 150, in that, keeper 275 extends from the forward side 268 of mounting bracket 261 adjacent the stop surface 47 and the projecting head 255 extends toward stop surface 47 from the pivot portion 257 of the pawl 251 below keeper 275. The spring 271 is again operatively interrelated with the pawl 251 and keeper 275 such that it applies a force to the pawl 251 urging the projecting head 255 toward the engaged position 250' (FIG. 15). In this embodiment, since the spring 271 bears upon a keeper 275 located at the forward side of the mounting bracket 261 above pivot member 260, and the spring force acts to drive the body portion 258 of pawl 251 rearwardly relative to stop surface 47, this causes a clockwise rotation of the pawl 251. As before, the rotation of pawl 251 urges the projecting head 255 into engagement with stop surface 47. Contact between projecting head 255 and stop surface 47 acts to frictionally decelerate door D, and contact of projecting head 255 with a surface 48 normal to its downward path may act as a positive stop as described above. Thus, if tension within the cable 45, which maintains the pawl 251 in the disengaged position, depicted in chain lines in FIG. 15, is released, spring 271 urges the head 255 of pawl 251 into stop surface 47 to decelerate door D, as described above.

To facilitate stopping engagement of the projecting head 255 with the stop surface 47 and/or a surface 48 normal to the direction of fall of the door D, projecting head 255 may extend inwardly and downwardly at an oblique angle relative to the body portion 254. The tip 255B of projecting head 255 may be square, relative to the top and bottom surfaces 255A, 255C thereof, as shown, causing a tip 255B to be oriented at an acute angle relative to the stop surface 47 upon engagement therewith. As in previous embodiments, when tension is released from the cable 45, the spring 271 urges the projecting head 255 toward the stop surface 47 until contact is made therewith and may further rotate the projecting head 255, in the presence of a notch 49, allowing the head 255 to enter the notch and contact a surface 48 normal to the downward fall of the door D acting as a positive stop. In further similarity to previous embodiments, during operation of the door D, tension is ordinarily released from the cable 45 as the door D nears the horizontal open position, thus, allowing some rotation of the pawl 251 upon each cycling of the door D between the open and closed positions preventing the build-up of dust, debris or corrosion at the stop assembly 250.

Thus, it should be evident that the anti-drop system disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

What is claimed is:

1. A door system comprising, a door movable between a closed vertical position and an open horizontal position, a cable attached to said door and normally providing a counterbalancing force to said door, said cable extending along a vertical line adjacent said door and being normally substantially taut, and an anti-drop assembly having a pawl pivotally mounted on a pivot support on said door and fixedly attached to said cable to transmit a selected counterbalance force through said pivot support to said door, a stop surface positioned adjacent to said door, and a spring operable to urge said pawl toward engagement with said stop surface, wherein when taut the cable opposes the biasing force of said spring and wherein upon said cable going slack said spring urges said pawl into engagement with said stop surface to decelerate said door.

2. The door system of claim 1 further comprising, a mounting bracket attached to an edge of said door, said pivot support carried by said mounting bracket extending axially outward therefrom and adapted to receive said pawl.

3. The door system of claim 2, wherein said spring has a first end and a second end, said first end engaging said pawl and said second end engaging said mounting bracket, wherein said spring is adapted to apply force between said mounting bracket and said pawl urging said pawl toward engagement with said stop surface.

4. The door system of claim 3, wherein said mounting bracket includes a keeper adapted to engage said second end of said spring.

5. The door system of claim 4, wherein said keeper is a member extending laterally outward from said mounting bracket adjacent said pawl.

6. The door system of claim 5, wherein said pawl has a pivot portion and said member extends adjacent said body portion of said pawl and defines a clearance for said pivot portion of said pawl.

7. The door system of claim 6, wherein said pivot support includes a boss extending axially outward from said mounting bracket, wherein said pivot portion is rotatably supported on said boss.

8. The door system of claim 7, wherein said boss defines a bore adapted to receive a shaft of a roller.

9. The door system of claim 7, wherein said boss is cylindrical and said pawl defines a circular opening adapted to fit over said boss.

10. The door system of claim 1, wherein said pawl includes a head extending toward said stop surface.

11. The door system of claim 10, wherein said pawl has a body portion and said head extends from said body portion.

12. The door system of claim 11, wherein said head extends from the top of said body portion.

13. The door system of claim 12, wherein said head extends generally perpendicular to said body portion and has a tip that is angled outwardly toward the stop surface from a top of said head to a bottom thereof.

14. The door system of claim 1, wherein said pawl has a body portion that defines a spring bore with said spring being at least partially received within said spring bore.

15. The door system of claim 1, wherein said pawl has a cable bore adapted to receive an end of said cable and wherein said end of said cable is secured to said pawl within said cable bore.

16. The door system of claim 1, wherein said stop surface is formed of a resilient polymer to permit an extent of temporary deformation upon engagement by said pawl.

17. A door system of comprising, a door movable between a closed vertical position and an open horizontal position, a cable attached to said door and normally providing a counterbalancing force to said door, said cable extending along a vertical line adjacent said door and being normally substantially taut, and an anti-drop assembly having a pawl pivotally supported on said door and attached to said cable, a stop surface positioned adjacent to said door, and a spring operable to urge said pawl toward engagement with said stop surface, wherein when taut said cable opposes the biasing force of said spring and wherein upon said cable going slack said spring urges said pawl into engagement with said stop surface to decelerate said door, said pawl having a body portion with a head extending from said body portion at an oblique angle relative to said body portion.

18. The door system of claim 17, wherein said pawl has a pivot portion and said head extends from said pivot portion of said pawl.

19. The door system of claim 18, wherein said head has a tip oriented at an acute angle relative to said stop surface.

20. A door system of comprising, a door movable between a closed vertical position and an open horizontal position, a cable attached to said door and normally providing a counterbalancing force to said door, said cable extending along a vertical line adjacent said door and being normally substantially taut, and an anti-drop assembly having a pawl pivotally supported on said door and attached to said cable, a stop surface positioned adjacent to said door, and a spring operable to urge said pawl toward engagement with said stop surface, wherein when taut said cable opposes the biasing force of said spring and wherein upon said cable going slack said spring urges said pawl into engagement with said stop surface to decelerate said door, said pawl having a body portion that defines a spring bore with said spring being at least partially received within said spring bore and said spring being a ball plunger having a spring-loaded plunger housed within a hollow casing, said casing being secured within said spring bore and said spring loaded plunger being axially moveable relative to said casing to apply the biasing force.

21. The door system of claim 20, wherein said casing is threadably received within said spring bore.

22. A door system of comprising, a door movable between a closed vertical position and an open horizontal position, a cable attached to said door and normally providing a counterbalancing force to said door, said cable extending along a vertical line adjacent said door and being normally substantially taut, and an anti-drop assembly having a pawl pivotally supported on said door and attached to said cable, a stop surface positioned adjacent to said door, and a spring operable to urge said pawl toward engagement with said stop surface, wherein when taut said cable opposes the biasing force of said spring and wherein upon said cable going slack said spring urges said pawl into engagement with said stop surface to decelerate said door, said pawl has a cable bore adapted to receive an end of said cable and wherein said end of said cable is secured to said pawl within said cable bore and a first bore in said pawl in registry with said cable bore and a fastener insertable through said first bore and protruding into said cable bore, whereby said fastener clamps said cable within said cable bore.

23. The door system of claim 22 further comprising a stud supported in said pawl and in registry with said cable bore and located in opposition to said first bore, whereby said cable is clamped between said stud and said fastener.

24. The door system of claim 23 further comprising a second bore and a second stud both in registry with said cable bore and located in opposition to each other; and a second fastener insertable within said second bore to clamp said cable to said pawl.

25. The door system of claim 23, wherein said stud tapers radially inwardly toward said fastener.

26. In a door system having a door movable between a closed vertical position and an open horizontal position and having a cable interconnected to said door near the bottom thereof and extending along a vertical line adjacent said door and being normally substantially taut, an anti-drop assembly comprising, a pawl having a body portion fixedly secured to the cable and a pivot portion rotably mounted on a pivot supported on the door to transmit a selected counterbalance force through said pivot support to the door, a stop surface mounted adjacent to the door, and means for biasing said pawl toward engagement with said stop surface, whereby said cable, when taut, holds the pawl against the force of said means for biasing and whereby when the tension is released from the cable said means for biasing urges said pawl into engagement with said stop surface to decelerate the door.

27. The door system of claim 26, wherein said stop surface includes at least one surface adapted to positively engage a portion of said pawl.

28. The door system of claim 27, wherein said surface adapted to positively engage a portion of said pawl is oriented normal to the direction of travel of the door.

29. The door system of claim 26, wherein said stop surface includes a notch adapted to receive a portion of said pawl.

30. The door system according to claim 26, wherein said stop surface has a plurality of spaced shallow notches for engagement by said tip of said pawl.

31. The door system according to claim 30, wherein said notches have a lower surface that is substantially perpendicular to the direction of travel of said door and the length of said pawl when in engagement with said lower surface to stop downward travel of said door.

32. The door system according to claim 31, wherein either of said pawl and said stop surface are constructed of a polymeric material.

33. The door system according to claim 31, wherein both said pawl and said stop surface are constructed of a polymeric material.

* * * * *